US010818989B2

(12) United States Patent
Zhang et al.

(10) Patent No.: US 10,818,989 B2
(45) Date of Patent: Oct. 27, 2020

(54) FILTER AND COMMUNICATIONS DEVICE

(71) Applicant: HUAWEI TECHNOLOGIES CO., LTD., Shenzhen (CN)

(72) Inventors: Xiaofeng Zhang, Kista (SE); Bengui Yuan, Shanghai (CN)

(73) Assignee: HUAWEI TECHNOLOGIES CO., LTD., Shenzhen (CN)

( * ) Notice: Subject to any disclaimer, the term of this patent is extended or adjusted under 35 U.S.C. 154(b) by 0 days.

(21) Appl. No.: 16/424,503

(22) Filed: May 29, 2019

(65) Prior Publication Data

US 2019/0280358 A1 Sep. 12, 2019

Related U.S. Application Data

(63) Continuation of application No. PCT/CN2016/107759, filed on Nov. 29, 2016.

(51) Int. Cl.

| | |
|---|---|
| ***H01P 1/208*** | (2006.01) |
| ***H01P 1/207*** | (2006.01) |
| ***H01P 1/212*** | (2006.01) |
| ***H01P 3/16*** | (2006.01) |
| ***H01P 5/08*** | (2006.01) |

(52) U.S. Cl.

CPC ..... *H01P 1/207* (2013.01); *H01P 1/2084* (2013.01); *H01P 1/212* (2013.01); *H01P 3/16* (2013.01); *H01P 5/087* (2013.01)

(58) Field of Classification Search

CPC ..... H01P 1/207; H01P 1/208; H01P 1/2084; H01P 1/201; H01P 1/212; H01P 5/087; H01P 5/08

USPC ..... 333/202, 208

See application file for complete search history.

(56) References Cited

U.S. PATENT DOCUMENTS

| | | | |
|---|---|---|---|
| 3,840,828 | A | 10/1974 | Linn et al. |
| 4,216,448 | A | 8/1980 | Kasuga et al. |
| 4,742,571 | A | 5/1988 | Letron |
| 5,969,584 | A | 10/1999 | Huang et al. |
| 7,042,314 | B2 | 5/2006 | Wang et al. |
| 2005/0217786 | A1 | 10/2005 | Geller et al. |

(Continued)

FOREIGN PATENT DOCUMENTS

| | | | |
|---|---|---|---|
| CN | 102013539 | A | 4/2011 |
| CN | 102694220 | A | 9/2012 |

(Continued)

*Primary Examiner* — Stephen E. Jones

(74) *Attorney, Agent, or Firm* — Kilpatrick Townsend & Stockton LLP

(57) ABSTRACT

A filter and a communications device are disclosed. The filter includes a metal cavity, a metal resonant cavity, and a metal cover covering the metal cavity and the metal resonant cavity. A dielectric waveguide is disposed in the metal cavity, and the dielectric waveguide is electrically connected to the metal cavity. Resonant rod is disposed in the metal resonant cavity. A coupling structure is disposed between the metal cavity and a metal resonant cavity that is neighboring to the metal cavity, the coupling structure includes a communication area between the metal cavity and the metal resonant cavity and a dielectric body that protrudes into the communication area, the dielectric body is connected to the dielectric waveguide, and the coupling structure is coupled to a resonant rod in the metal resonant cavity.

20 Claims, 4 Drawing Sheets

(56) References Cited

U.S. PATENT DOCUMENTS

| | | | | |
|---|---|---|---|---|
| 2007/0152779 | A1* | 7/2007 | Ando | H01P 7/105<br>333/202 |
| 2014/0292438 | A1 | 10/2014 | Yatabe et al. | |
| 2015/0061793 | A1 | 3/2015 | Zhou et al. | |
| 2015/0077198 | A1 | 3/2015 | Yatabe | |

FOREIGN PATENT DOCUMENTS

| | | | |
|---|---|---|---|
| CN | 202839929 | U | 3/2013 |
| CN | 104362417 | A | 2/2015 |
| CN | 104466339 | A | 3/2015 |
| CN | 105489982 | A | 4/2016 |
| CN | 205141103 | U | 4/2016 |
| CN | 105896002 | A | 8/2016 |
| EP | 1300908 | A1 | 4/2003 |

* cited by examiner

FILTER AND COMMUNICATIONS DEVICE

CROSS-REFERENCE TO RELATED APPLICATIONS

This application is a continuation of International Application No. PCT/CN2016/107759, filed on Nov. 29, 2016, the disclosure of which is hereby incorporated by reference in its entirety.

TECHNICAL FIELD

This application relates to the field of communications technologies, and in particular, to a filter and a communications device.

BACKGROUND

A dielectric waveguide filter is a common form of a miniaturized filter used in a wireless communications device (for example, a base station). However, the dielectric waveguide filter has poor remote harmonic suppression performance, restricting an application scenario of the dielectric waveguide filter. To improve the remote harmonic suppression performance, usually an extra low-pass component (for example, a microstrip) is used in a dielectric waveguide filter in the prior art to perform low-pass suppression of a remote harmonic. Use of the extra low-pass component leads to an extra signal loss, and assembly complexity is relatively high.

SUMMARY

This application provides a filter and a communications device, to improve performance of the filter without adding an extra signal loss, thereby improving applicability of the filter.

This application provides a filter. The filter includes a metal cavity, a metal resonant cavity, and a metal cover covering the metal cavity and the metal resonant cavity. A dielectric waveguide is disposed in the metal cavity, and the dielectric waveguide is electrically connected to the metal cavity. Resonant rod is disposed in the metal resonant cavity. A coupling structure is disposed between the metal cavity and a metal resonant cavity that is neighboring to the metal cavity, the coupling structure includes a communication area between the metal cavity and the metal resonant cavity and a dielectric body that protrudes into the communication area, the dielectric body is connected to the dielectric waveguide, and the coupling structure is coupled to a resonant rod in the metal resonant cavity. Because a frequency of a remote harmonic of a metal resonant cavity is farther away from a passband frequency, when the dielectric waveguide and the metal resonant cavity are jointly used, a remote harmonic of the entire filter can be effectively suppressed. In addition, the dielectric waveguide is coupled to the metal resonant cavity by using an electromagnetic field of a coupling connection area. Higher electromagnetic field strength of the coupling connection area indicates a higher requirement on precision of a shape, a size, and the like of the coupling connection area, that is, a higher requirement on assembly precision and engineering implementation of the filter. In this application, because electromagnetic field strength inside the dielectric body is weaker than electromagnetic field strength in the air, when the dielectric body protrudes into the communication area between the metal cavity and the metal resonant cavity, the electromagnetic field strength of the coupling connection area can be reduced, that is, sensitivity of a cascade structure between the dielectric waveguide and the metal cavity can be reduced, thereby reducing a requirement on precision of the coupling connection area, and reducing a requirement on the assembly precision and an engineering implementation difficulty of the filter.

In a possible design, the dielectric body has a surface facing the resonant rod in the metal resonant cavity, and a non-metalized area is disposed on the surface facing the resonant rod in the metal resonant cavity. The dielectric body is coupled to the resonant rod by using the non-metalized area. In addition, during specific disposing, the non-metalized area may have different shapes such as a rectangle and a round. In addition, in a possible design, the surface of the dielectric body facing the resonant rod may be entirely non-metal, or a part of the surface may be covered by metal, and non-metalized areas having different shapes may be formed through windowing.

In a possible design, a surface of the dielectric body is covered by a conductive metal layer. Optionally, the conductive metal layer is made of silver, and when the conductive metal layer covers the surface of the dielectric body, the conductive metal layer does not cover a non-metalized area of the surface of the dielectric body facing the resonant rod.

In a possible design, the dielectric body is a tapered structure whose cross-sectional area in a direction away from the dielectric waveguide gradually decreases. The design of the dielectric body can effectively reduce sensitivity of the cascade structure between the dielectric waveguide and the metal cavity. In addition, the foregoing structure can reduce an assembly precision requirement of the entire filter.

In a possible design, the dielectric waveguide and the dielectric body are of an integral structure. Therefore, the dielectric waveguide and the dielectric body may be integrally manufactured, thereby improving intensity of a connection between the dielectric body and the dielectric waveguide, and facilitating manufacturing of a component.

In a possible design, there are at least two metal resonant cavities, and neighboring metal resonant cavities are coupled together. The coupling connection may be implemented by using a coupling window, or the coupling connection may be implemented in another coupling manner.

At least two dielectric waveguides are disposed in one metal cavity, the at least two dielectric waveguides are stacked in the metal cavity, and a non-metalized area is disposed on a surface, of one dielectric waveguide, in contact with another dielectric waveguide. To be specific, there may be different quantities of dielectric waveguides. For example, when there are two dielectric waveguides, the dielectric waveguides are arranged in a two-layer iteration arrangement manner. Cross coupling may be formed between the plurality of dielectric waveguides and the metal resonant cavity, and the cross coupling can effectively improve a near-end suppression capability of a passband of the filter.

In a possible design, at least one dielectric resonant cavity is disposed in the dielectric waveguide, and when at least two dielectric resonant cavities are disposed in the dielectric waveguide, the at least two dielectric resonant cavities are coupled together.

In a possible design, the metal cavity and the metal resonant cavity are arranged in a single row. Therefore, a structure of the entire filter is more compact, facilitating miniaturization development of the filter. Certainly, it should be understood that the metal cavity in the filter is not limited to the foregoing single-row arrangement, and another arrangement manner may be used. For example, when three metal cavities are used, the metal cavities are arranged with one at top and two at bottom.

In a possible design, the metal cavity is located on one side of the metal resonant cavity (or metal resonant cavities) that are arranged in a single row. To be specific, the metal cavity in which the dielectric waveguide is disposed is disposed on one end of the metal cavity that is arranged in a single row, and certainly, the dielectric waveguide may be placed at a middle location. When the dielectric waveguide is disposed on one end of the metal cavity, compactness of the structure of the filter can be further improved.

In a possible design, the dielectric waveguide is fixedly connected to the metal cavity by using a conductive adhesive or a metal dome. To be specific, the dielectric waveguide can be electrically connected to the metal cavity and the dielectric waveguide can be fastened in the metal cavity in different conductive connection manners.

This application further provides a communications device. The communications device includes the filter described above. Optionally, the communications device may be a network device in a wireless communications network, for example, a base station or a wireless transceiver apparatus, or may be user equipment, for example, a mobile phone.

In the foregoing embodiments, because the frequency of the remote harmonic of the metal resonant cavity is farther away from the passband frequency, after the metal resonant cavity are used in the filter, the remote harmonic of the entire filter can be effectively suppressed. In addition, the dielectric waveguide is coupled to the metal resonant cavity by using the electromagnetic field of the coupling connection area. Higher electromagnetic field strength of the coupling connection area indicates a higher requirement on precision of a shape, a size, and the like of the coupling connection area, that is, a higher requirement on assembly precision and engineering implementation of the filter. In this application, because electromagnetic field strength inside the dielectric body is weaker than electromagnetic field strength in the air, when the dielectric body protrudes into the communication area between the metal cavity and the metal resonant cavity, the electromagnetic field strength of the coupling connection area can be reduced, thereby reducing a requirement on precision of the coupling connection area, and reducing a requirement on assembly precision and engineering implementation of the filter.

REFERENCE NUMERALS

Figure 1:
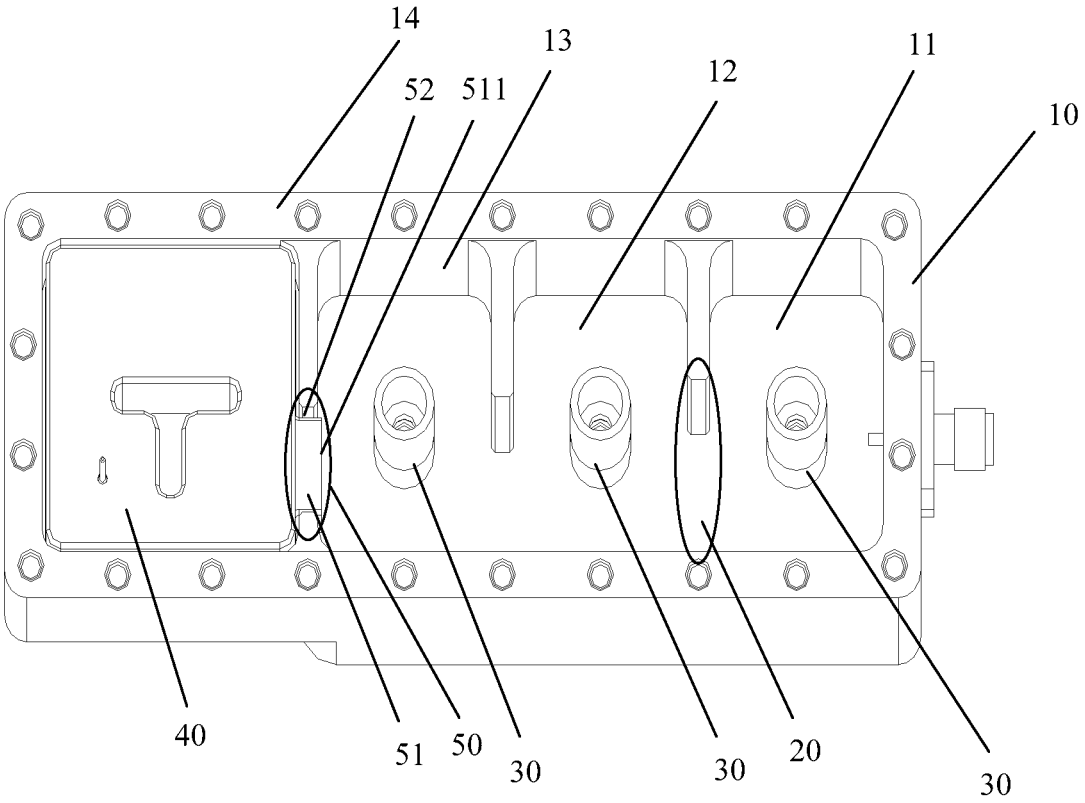
FIG. 1 to FIG. 4 are schematic diagrams of filters of different structures according to an embodiment.

10—metal housing; 11—first metal resonant cavity; 12—second metal resonant cavity; 13—third metal resonant cavity;

14—metal cavity; 20—coupling window; 30—resonant rod; 40—dielectric waveguide; 50—coupling structure; 51—dielectric body; 511—coupling surface; 52—communication area; and 60—metal dome.

DESCRIPTION OF EMBODIMENTS

The following further describes the embodiments of this application in detail with reference to the accompanying drawings.

FIG. 1 to FIG. 4 show filters of different structures. In the structures, no metal cover is shown.

An embodiment of this application provides a filter. The filter includes a metal cavity 14, a metal resonant cavity, and a metal cover covering the metal cavity 14 and the metal resonant cavity. A dielectric waveguide 40 is disposed in the metal cavity 14, and the dielectric waveguide 40 is electrically connected to the metal cavity 14. Resonant rod 30 is disposed in the metal resonant cavity. A coupling structure 50 is disposed between the metal cavity 14 and a metal resonant cavity that is neighboring to the metal cavity 14, the coupling structure 50 includes a communication area 52 between the metal cavity 14 and the metal resonant cavity and a dielectric body 51 that protrudes into the communication area 52, the dielectric body 51 is connected to the dielectric waveguide 40, and the coupling structure 50 is coupled to a resonant rod 30 in the metal resonant cavity.

Figure 2:
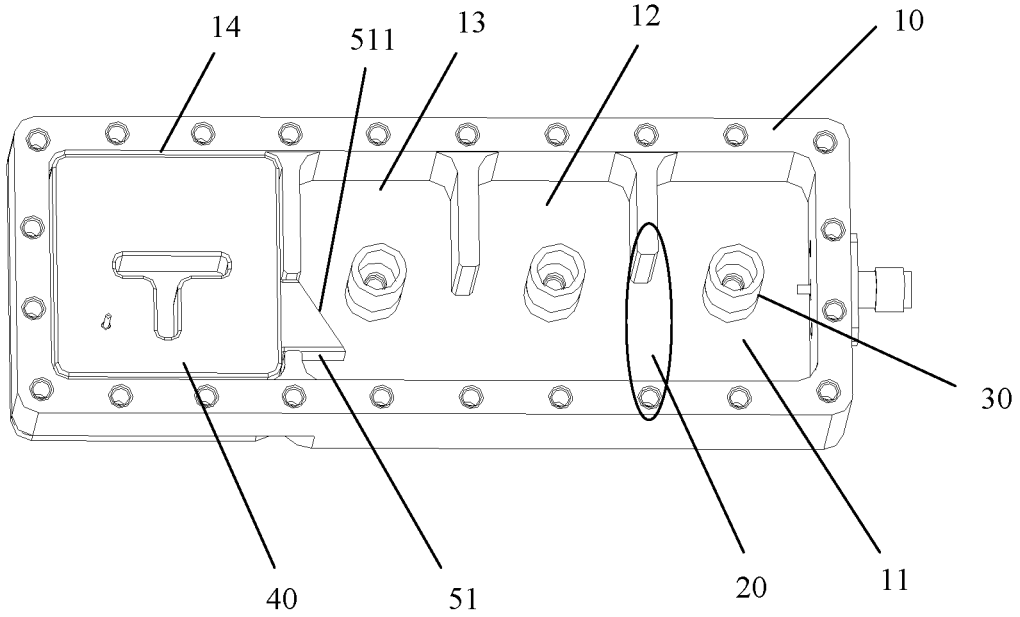
Figure 3:
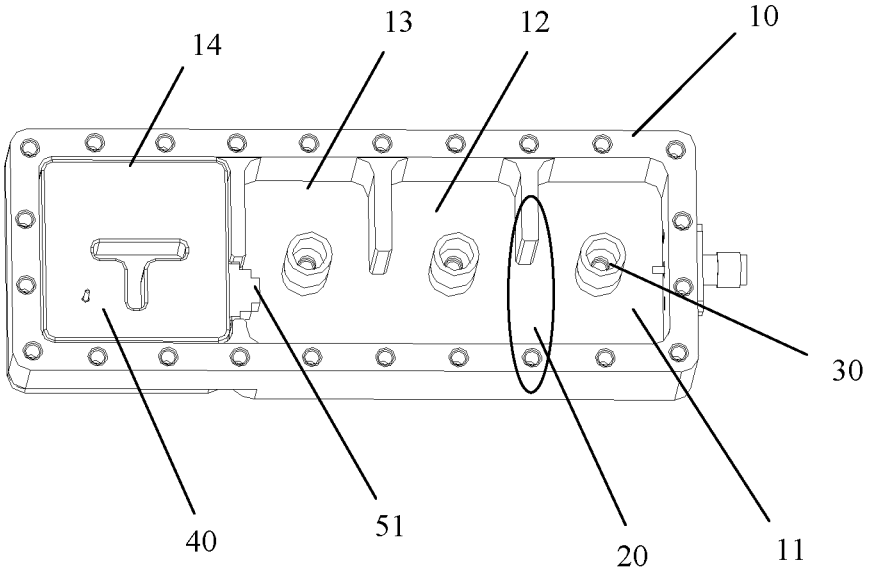
Figure 4:
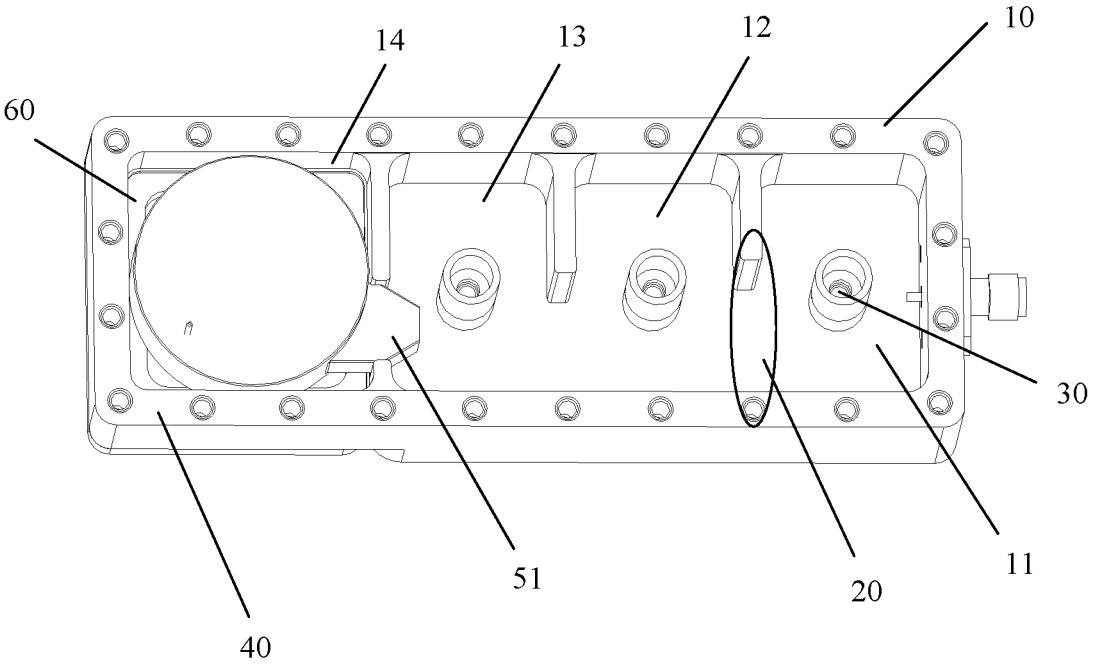

Referring to FIG. 1 again, as can be seen from FIG. 1, the metal cavity 14 and the metal resonant cavities that are provided in this embodiment are cavities formed on one metal housing 10. For ease of description, four cavities shown in FIG. 1 are used as an example for description. In the filter shown in FIG. 1, a direction in which the filter is placed in FIG. 1 is used as a reference direction. The four cavities are respectively the metal cavity 14, a third metal resonant cavity 13, a second metal resonant cavity 12, and a first metal resonant cavity 11 from the left to the right, and heights of the four cavities are the same. The metal cavity 14 is a cavity in which the dielectric waveguide 40 is placed. The resonant rods 30 are respectively disposed in the remaining three cavities, so that the remaining three cavities are used as three metal resonant cavities. In addition, during specific disposing, neighboring metal resonant cavities are coupled together. Specifically, in a manner shown in FIG. 1, the metal resonant cavities are connected by using coupling windows 20. To be specific, the coupling windows 20 are respectively disposed between the third metal resonant cavity 13 and the second metal resonant cavity 12 and between the second metal resonant cavity 12 and the first metal resonant cavity 11, and coupling between the three metal resonant cavities is implemented by using the coupling windows 20. In addition, the metal cavity 14 and the third metal resonant cavity 13 are coupled together by using the dielectric body 51. The coupling structure 50 includes two parts, namely, the communication area 52 between the metal cavity 14 and the third metal resonant cavity 13, and the dielectric body 51 that protrudes into the communication area 52. Using the structure shown in FIG. 1 as an example, the communication area 52 is a window provided on a separate wall between the metal cavity 14 and the third metal resonant cavity 13, and the metal cavity 14 and the third metal resonant cavity 13 are coupled together by using the window and the dielectric body 51 that protrudes into the window. During specific disposing, for the dielectric body 51, as shown in FIG. 1, the dielectric body 51 may be located in the communication area 52 but does not protrude into the third metal resonant cavity 13, or as shown in FIG. 2 to FIG. 4, the dielectric body 51 passes through the communication area 52 and protrudes into the third metal resonant cavity 13.

The dielectric waveguide 40 can be coupled to the third metal resonant cavity 13 regardless of which structure is used. A frequency of a remote harmonic of a metal resonant cavity is farther away from a passband frequency. For example, a frequency of a remote harmonic of a resonant cavity of the dielectric waveguide 40 usually is 1.7 times the passband frequency, and the frequency of the remote harmonic of the metal resonant cavity may be three times the passband frequency or even higher. Therefore, after the metal resonant cavities are used in the filter, a remote harmonic of the entire filter can be effectively suppressed. In addition, the dielectric waveguide 40 is coupled to the metal resonant cavity by using an electromagnetic field of a coupling connection area. Higher electromagnetic field strength of the coupling connection area indicates a higher requirement on precision of a shape, a size, and the like of the coupling connection area, that is, a higher requirement on assembly precision and engineering implementation of the filter. In this application, because electromagnetic field strength inside the dielectric body 51 is weaker than electromagnetic field strength in the air, when the dielectric body 51 protrudes into the communication area 52 between the metal cavity 14 and the metal resonant cavity 13, the electromagnetic field strength of the coupling connection area can be reduced, thereby reducing a requirement on precision of the coupling connection area, and reducing a requirement on assembly precision and engineering implementation of the filter.

Figure 5:
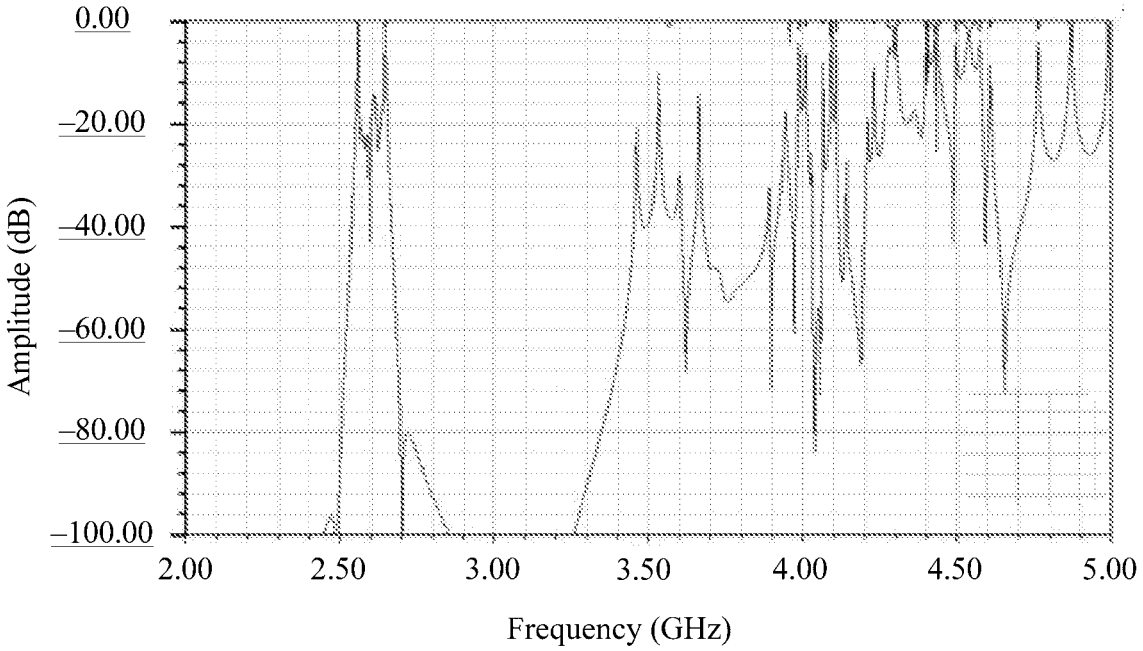
FIG. 5 is a schematic diagram of a remote response of a filter including only a dielectric waveguide in the prior art.
Figure 6:
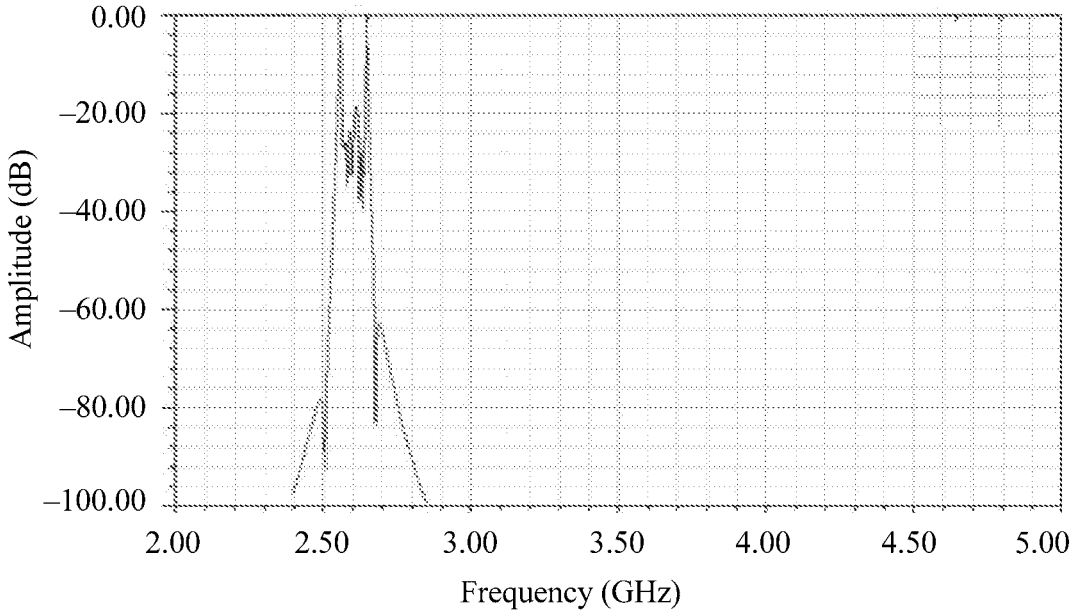
FIG. 6 is a schematic diagram of a remote response of a filter according to an embodiment.

For ease of understanding performance of the filter provided in this embodiment, FIG. 5 is a schematic diagram of a remote response of a filter including only a dielectric waveguide in the prior art, and FIG. 6 is a schematic diagram of a remote response of the filter provided in this embodiment. As can be learned through comparison between FIG. 5 and FIG. 6, for the filter including only the dielectric waveguide, when a frequency is 1.4 times a passband center frequency, a relatively large clutter occurs in the response of the filter, while after a metal resonant cavity cascade structure is used (that is, in this embodiment of this application), remote clutters that occur when a frequency is less than 3 times the center frequency have been filtered.

As can be learned from the foregoing descriptions, when there are at least two metal resonant cavities in this application, neighboring metal resonant cavities are coupled together, but a coupling manner is not limited to a specific coupling connection manner using a coupling window, and another coupling connection structure may be alternatively used in this application.

Optionally, in this embodiment of this application, a quantity of metal cavities 14 including a dielectric waveguide is not limited to the quantity of metal cavities 14 shown in FIG. 1, and two or more metal cavities and dielectric waveguides in the metal cavities may be disposed as required. A specific disposing manner and a design manner of a coupling structure are respectively the same as those of the metal cavity 14 and the coupling structure 50, and details are not described again. In addition, when a plurality of metal cavities 14 each having a dielectric body 51 are used, at least one metal resonant cavity is disposed between two neighboring metal cavities. Optionally, a quantity of metal resonant cavities is not limited either, but there is at least one metal resonant cavity. The quantity of metal cavities is related only to a suppression degree of a remote harmonic. For example, when a remote suppression requirement is 10 dB, one metal cavity 14 may be disposed, and when a remote harmonic requirement is 70 dB, at least three metal resonant cavities may be disposed.

Optionally, the dielectric waveguide 40 used in this embodiment is made of dielectric ceramic, and a surface is covered by a conductive metal layer. Optionally, the conductive metal layer is made of silver, and may be of different shapes, for example, a rectangle shape shown in FIG. 1 to FIG. 3, or a cylinder shape shown in FIG. 4. To be specific, a shape of the dielectric waveguide 40 provided in this embodiment is not limited, and may vary with an actual case. In addition, the dielectric waveguide 40 provided in this embodiment may include different quantities of dielectric resonant cavities, but there should be at least one dielectric resonant cavity, as shown in FIG. 4. The dielectric waveguide 40 shown in FIG. 4 includes one dielectric resonant cavity. The dielectric waveguides 40 shown in FIG. 1 to FIG. 3 each include at least two dielectric resonant cavities, and the plurality of dielectric resonant cavities are coupled together. When at least two dielectric resonant cavities are used, grooves are formed on the dielectric waveguide to form different quantities of dielectric resonant cavities. As shown in FIG. 1 to FIG. 3, at least two dielectric resonant cavities are formed on the dielectric body 51 by using a T-shaped groove.

Figure 7:
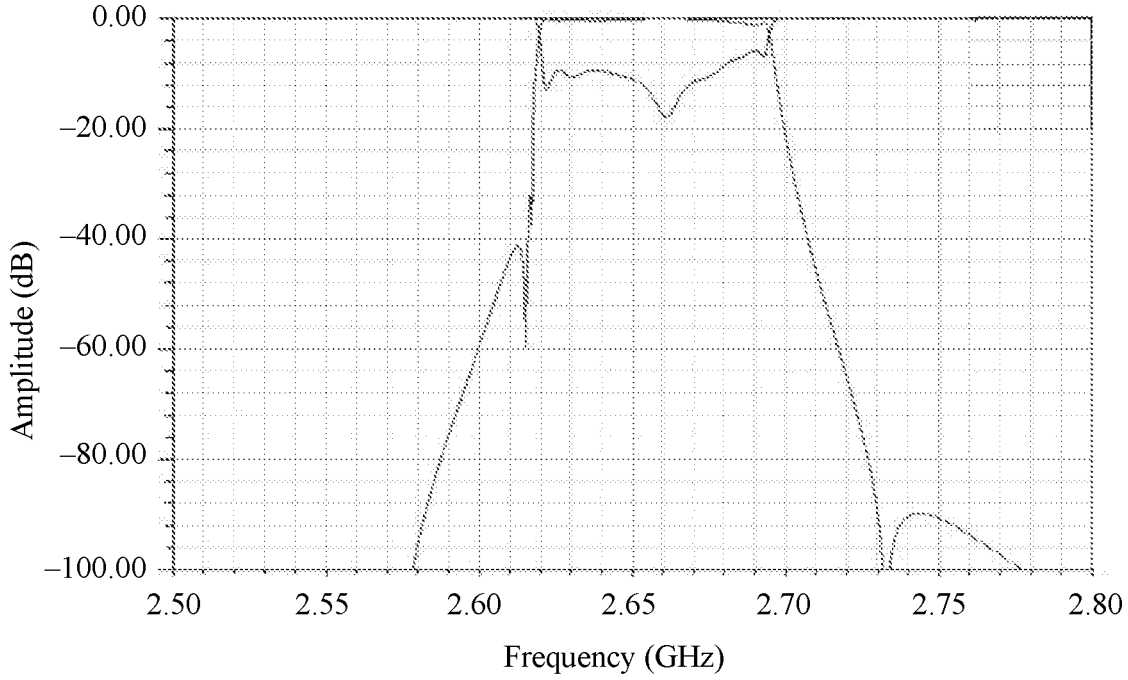
FIG. 7 is a schematic diagram of a near-end response of a filter when two dielectric waveguides are disposed in one metal cavity.

For a size of the dielectric waveguide 40, in this embodiment, a height of each dielectric waveguide 40 is lower than a height of the metal cavity 14, and when there are at least two dielectric waveguides 40, the at least two dielectric waveguides 40 are stacked in the metal cavity 14. For example, two dielectric waveguides 40 are used, and the dielectric waveguides 40 are stacked and disposed in the metal cavity 14 at two layers. In this case, the dielectric waveguides 40 at upper and lower layers are in cascade coupling to the metal resonant cavity by using the dielectric body 51. However, it should be noted that when a plurality of dielectric waveguides 40 are used, a height obtained after the plurality of dielectric waveguides 40 are arranged is also lower than the height of the metal cavity 14, so that the dielectric waveguides 40 can be placed in the metal cavity 14. Optionally, when at least two dielectric waveguides are disposed in one metal cavity, each dielectric waveguide is connected to one dielectric body, and is coupled to the resonant rod in the metal resonant cavity by using the dielectric body connected to the dielectric waveguide. A non-metalized area is disposed on a contact surface between two dielectric waveguides in contact, to implement a coupling connection between the dielectric waveguides. When at least two dielectric waveguides are used, the plurality of dielectric waveguides 40 may be in cross coupling to the metal resonant cavity. The cross coupling can effectively improve a near-end suppression capability of a passband of the filter. FIG. 7 shows a frequency response curve when two layers of dielectric waveguides 40 are in cross coupling to the metal resonant cavity 13. As can be learned from comparison between FIG. 7 and FIG. 6, an out-of-band suppression effect is better in FIG. 7.

The dielectric waveguide 40 is coupled to the metal resonant cavity by using the dielectric body 51. Specifically, as shown in FIG. 1, the coupling structure 50 includes the communication area 52 and the dielectric body 51. The dielectric body 51 is coupled to the resonant rod 30 in the third metal resonant cavity 13. During specific disposing, the dielectric body 51 may protrude into the communication area 52, or may pass through the communication area 52 and protrude into the third metal resonant cavity 13, and have a surface (a coupling surface 511) facing the resonant rod 30, to implement coupling between the two. A non-metalized area is disposed on the coupling surface 511, and the coupling surface 511 is coupled to the resonant rod 30 by using the non-metalized area. In a feasible solution, an area and a shape of the non-metalized area are not limited, for example, the non-metalized area is a rectangle or a round. In addition, during specific disposing, the entire coupling surface 511 may be a non-metalized area, or a part of the coupling surface 511 may be a non-metalized area. For example, in a solution, a surface of the body is covered by a conductive metal layer, but the coupling surface 511 of the dielectric body 51 is not covered by the conductive metal layer, and the coupling surface 511 is exposed.

In a specific embodiment, the dielectric body 51 and the dielectric waveguide 40 are of an integral structure. To be specific, the dielectric waveguide 40 and the dielectric body 51 are formed by using one material, to improve intensity of connection between the two, and facilitate manufacturing of the entire component. During specific disposing, the dielectric waveguide 40 may be provided with a structure, shown in FIG. 1, whose cross-sectional area is constant, or may be designed to have a structure whose cross-sectional area gradually changes. Specifically, the dielectric body 51 is a tapered structure whose cross-sectional area in a direction away from the dielectric waveguide 40 gradually decreases. The tapered dielectric body 51 can effectively reduce sensitivity of a cascade structure between the dielectric waveguide 40 and the metal cavity. However, a specific shape of the tapered dielectric body 51 is not limited. In the following example, as shown in FIG. 2, the surface of the dielectric body 51 facing the resonant rod 30 is an inclined surface, to implement the structure whose cross-sectional area gradually decreases. In this manner, a coupling area between the dielectric waveguide 40 and the resonant rod 30 can be increased, thereby increasing coupling. As shown in FIG. 3, the dielectric body 51 is of a stepped structure, to implement gradual changing. As shown in FIG. 4, the dielectric body 51 is of a structure having two relatively inclined surfaces, to implement a gradual decrease of a cross-sectional area. However, it should be understood that the dielectric body 51 provided in this embodiment of this application may be of different shapes, and is not limited to the structures and the shapes shown in FIG. 2 to FIG. 4.

When the dielectric waveguide 40 is electrically connected to the metal cavity 14, the dielectric waveguide 40 and the metal cavity 14 may be fixedly connected by using a conductive adhesive or a metal dome 60, and are conducted. To be specific, the dielectric waveguide 40 can be electrically connected to the metal cavity 14 and the dielectric waveguide 40 can be fastened in the metal cavity 14 in different conductive connection manners. As shown in FIG. 1 and FIG. 2, the dielectric waveguide 40 is connected to the metal cavity 14 by using the conductive adhesive. As shown in FIG. 3, the dielectric waveguide 40 is connected to the metal cavity 14 by using the metal dome 60. In the foregoing connection manners, no welding is needed when the dielectric waveguide 40 is connected to the metal cavity 14, and a mixed design structure of the dielectric waveguide 40 and the metal cavity has a simple assembly process.

When the metal cavity 14 and the metal resonant cavity are disposed, a single-row arrangement manner shown in FIG. 1 may be used as a disposing manner. To be specific, the metal resonant cavity (or the metal resonant caavities) and the metal cavity are arranged in a single row, as shown in FIG. 1 to FIG. 4. Therefore, a structure of the entire filter is more compact, facilitating miniaturization development of the filter. Certainly, it should be understood that the metal cavity 14 and the metal resonant cavity in the filter are not limited to the foregoing single-row arrangement, that is, an arrangement manner of the cavities may change. The linear arrangement in the example is merely an example, and a triangular shape may be used or the cavities may be arranged with one at top and two at bottoms, provided that a corresponding coupling relationship is ensured.

When the metal cavity 14 and the metal resonant cavities are disposed in the single-row arrangement manner, the metal resonant cavity is located on one side of the metal resonant cavities. To be specific, as shown in FIG. 1, the metal cavity 14 is disposed on one end of the metal resonant cavities that are arranged in a single row. Certainly, the metal cavity 14 may be at another location. For example, the metal cavity 14 is located between a plurality of metal resonant cavities. In this case, the metal cavity 14 is separately coupled to metal resonant cavities that are located on two sides of the metal cavity 14. During specific coupling, the coupling structure 50 described in the foregoing solution may be used to implement coupling. When the metal cavity 14 is disposed on one end of the metal resonant cavities, compactness of the structure of the filter can be further improved.

As can be learned from the foregoing descriptions, in the filter provided in this embodiment, the dielectric waveguide 40 and the metal resonant cavities are designed in a mixed manner, and the dielectric waveguide 40 is directly placed inside the metal cavity 14, to form the entire filter. The metal cavity 14 in which the dielectric waveguide 40 is placed does not participate in resonance of the filter, changes of the shape and the size of the cavity do not affect performance of the filter, and the shape and the size may be designed as required. This is not limited in this application.

In this application, the metal cavity 14 and the metal resonant cavity each are a cavity having an opening. To prevent signal leakage, the filter in this application further includes the metal cover. The metal cover covers the openings of the cavities to seal the cavities, thereby preventing signal leakage.

This application further provides a communications device. The communications device includes the filter described above. Optionally, the communications device may be a network device in a wireless communications network, for example, a base station or a wireless transceiver apparatus, or may be user equipment, for example, a mobile phone.

In the foregoing embodiments, because the frequency of the remote harmonic of the metal resonant cavity is farther away from the passband frequency, after the metal resonant cavity are used in the filter, the remote harmonic of the entire filter can be effectively suppressed. In addition, the dielectric waveguide 40 is coupled to the metal resonant cavity by using the coupling structure 50, thereby reducing sensitivity of the cascade structure between the dielectric waveguide and the metal cavity, and reducing a requirement on assembly precision and engineering implementation of the filter.

Obviously, a person skilled in the art can make various modifications and variations to this application without departing from the spirit and scope of this application. This application is intended to cover these modifications and variations of this application provided that they fall within the scope of protection defined by the claims of this application and their equivalent technologies.

What is claimed is:

1. A filter, comprising a metal cavity, a metal resonant cavity, and a metal cover covering the metal cavity and the metal resonant cavity, wherein a dielectric waveguide is disposed in the metal cavity, and the dielectric waveguide is electrically connected to the metal cavity;

resonant rod is disposed in the metal resonant cavity; and a coupling structure is disposed between the metal cavity and a metal resonant cavity that is neighboring to the metal cavity, the coupling structure comprises a communication area between the metal cavity and the metal resonant cavity and a dielectric body that protrudes into the communication area, the dielectric body is connected to the dielectric waveguide, and the coupling structure is coupled to a resonant rod in the metal resonant cavity.

2. The filter according to claim 1, wherein the dielectric body has a surface facing the resonant rod in the metal resonant cavity, and a non-metalized area is disposed on the surface facing the resonant rod in the metal resonant cavity.

3. The filter according to claim 2, wherein a surface of the dielectric body is covered by a conductive metal layer.

4. The filter according to claim 1, wherein the dielectric body is a tapered structure whose cross-sectional area in a direction away from the dielectric waveguide gradually decreases.

5. The filter according to claim 1, wherein the dielectric waveguide and the dielectric body are of an integral structure.

6. The filter according to claim 1, wherein there are at least two metal resonant cavities, and neighboring metal resonant cavities are coupled together.

7. The filter according to claim 1, wherein at least two dielectric waveguides are disposed in one metal cavity, the at least two dielectric waveguides are stacked in the metal cavity, and a non-metalized area is disposed on a surface, of one dielectric waveguide, in contact with another dielectric waveguide.

8. The filter according to claim 1, wherein at least one dielectric resonant cavity is disposed on the dielectric waveguide, and when at least two dielectric resonant cavities are disposed on the dielectric waveguide, the at least two dielectric resonant cavities are coupled together.

9. The filter according to claim 1, wherein the metal cavity and the metal resonant cavity are arranged in a single row.

10. The filter according to claim 9, wherein the metal cavity is located on one side of the metal resonant cavities that are arranged in a single row.

11. The filter according to claim 1, wherein the dielectric waveguide is fixedly connected to the metal cavity by using a conductive adhesive or a metal dome.

12. A communications device, comprising a filter, wherein the filter comprising a metal cavity, a metal resonant cavity, and a metal cover covering the metal cavity and the metal resonant cavity, wherein a dielectric waveguide is disposed in the metal cavity, and the dielectric waveguide is electrically connected to the metal cavity;

resonant rod is disposed in the metal resonant cavity; and a coupling structure is disposed between the metal cavity and a metal resonant cavity that is neighboring to the metal cavity, the coupling structure comprises a communication area between the metal cavity and the metal resonant cavity and a dielectric body that protrudes into the communication area, the dielectric body is connected to the dielectric waveguide, and the coupling structure is coupled to a resonant rod in the metal resonant cavity.

13. The device according to claim 12, wherein the dielectric body has a surface facing the resonant rod in the metal resonant cavity, and a non-metalized area is disposed on the surface facing the resonant rod in the metal resonant cavity.

14. The device according to claim 12, wherein a surface of the dielectric body is covered by a conductive metal layer.

15. The device according to claim 12, wherein the dielectric body is a tapered structure whose cross-sectional area in a direction away from the dielectric waveguide gradually decreases.

16. The device according to claim 12, wherein the dielectric waveguide and the dielectric body are of an integral structure.

17. The device according to claim 12, wherein there are at least two metal resonant cavities, and neighboring metal resonant cavities are coupled together.

18. The device according to claim 12, wherein at least two dielectric waveguides are disposed in one metal cavity, the at least two dielectric waveguides are stacked in the metal cavity, and a non-metalized area is disposed on a surface, of one dielectric waveguide, in contact with another dielectric waveguide.

19. The device according to claim 12, wherein at least one dielectric resonant cavity is disposed on the dielectric waveguide, and when at least two dielectric resonant cavities are disposed on the dielectric waveguide, the at least two dielectric resonant cavities are coupled together.

20. The device according to claim 12, wherein the metal cavity and the metal resonant cavity are arranged in a single row.

* * * * *